US012655508B2

(12) United States Patent
Gao et al.

(10) Patent No.: US 12,655,508 B2
(45) Date of Patent: Jun. 16, 2026

(54) NON-QUENCHED AND TEMPERED ROUND STEEL WITH HIGH STRENGTH, HIGH TOUGHNESS AND EASY CUTTING AND MANUFACTURING METHOD THEREFOR

(71) Applicant: BAOSHAN IRON & STEEL CO., LTD., Shanghai (CN)

(72) Inventors: Jiaqiang Gao, Shanghai (CN); Sixin Zhao, Shanghai (CN); Zongze Huang, Shanghai (CN); Lin Chen, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 364 days.

(21) Appl. No.: 18/271,172

(22) PCT Filed: Jan. 12, 2022

(86) PCT No.: PCT/CN2022/071570
§ 371 (c)(1),
(2) Date: Jul. 6, 2023

(87) PCT Pub. No.: WO2022/152158
PCT Pub. Date: Jul. 21, 2022

(65) Prior Publication Data

US 2024/0052470 A1 Feb. 15, 2024

(30) Foreign Application Priority Data

Jan. 12, 2021 (CN) ..... 202110035295.6

(51) Int. Cl.
*C22C 38/58* (2006.01)
*C21D 8/06* (2006.01)
(Continued)

(52) U.S. Cl.
CPC ..... *C22C 38/58* (2013.01); *C21D 8/06* (2013.01); *C22C 38/02* (2013.01); *C22C 38/06* (2013.01);
(Continued)

(58) Field of Classification Search
None
See application file for complete search history.

(56) References Cited

U.S. PATENT DOCUMENTS

2016/0017468 A1 1/2016 Kuznetsov et al.

FOREIGN PATENT DOCUMENTS

CN 102286698 A 12/2011
CN 102899589 1/2013
(Continued)

OTHER PUBLICATIONS

International Search Report in Application No. PCT/CN2022/071570 dated Apr. 1, 2022, 2 pages.
(Continued)

*Primary Examiner* — Jenny R Wu
(74) *Attorney, Agent, or Firm* — Barclay Damon LLP

(57) ABSTRACT

Disclosed is a non-quenched and tempered round steel with high strength, high toughness and easy cutting, comprising the following chemical elements in percentage by mass: C: 0.36-0.45%, Si: 0.20-0.70%, Mn: 1.25-1.85%, Cr: 0.15-0.55%, Ni: 0.10-0.25%, Mo: 0.10-0.25%, Al: 0.02-0.05%, Nb: 0.001-0.040%, V: 0.10-0.25%, S: 0.02-0.06%, and the balance being Fe and inevitable impurities. Also disclosed is a method for manufacturing the non-quenched and tempered round steel, comprising the steps of: S1: smelting and casting; S2: heating; S3: forging or rolling; and S4: finishing. The non-quenched and tempered round steel with high strength, high toughness and easy cutting described above has high strength, good impact toughness, elongation and
(Continued)

cross-sectional shrinkage, and has good cutting performance and fatigue resistance, and can be used in situations requiring a high-strength steel material, such as automobiles and engineering machinery.

8 Claims, 1 Drawing Sheet

(51) Int. Cl.

| | |
|---|---|
| ***C22C 38/02*** | (2006.01) |
| ***C22C 38/06*** | (2006.01) |
| ***C22C 38/24*** | (2006.01) |
| ***C22C 38/26*** | (2006.01) |
| ***C22C 38/42*** | (2006.01) |
| ***C22C 38/44*** | (2006.01) |
| ***C22C 38/60*** | (2006.01) |

(52) U.S. Cl.

CPC ..... *C22C 38/24* (2013.01); *C22C 38/26* (2013.01); *C22C 38/42* (2013.01); *C22C 38/44* (2013.01); *C22C 38/60* (2013.01); *C21D 2211/001* (2013.01); *C21D 2211/002* (2013.01); *C21D 2211/005* (2013.01); *C21D 2211/009* (2013.01)

(56) References Cited

FOREIGN PATENT DOCUMENTS

| | | | | | |
|---|---|---|---|---|---|
| CN | 102899589 | A | | 1/2013 | |
| CN | 104451417 | A | | 3/2015 | |
| CN | 109666856 | A | | 4/2019 | |
| CN | 111304517 | A | | 6/2020 | |
| CN | 111778443 | A | * | 10/2020 | ..... C22C 38/001 |
| CN | 112195412 | A | * | 1/2021 | ..... C22C 38/44 |
| CN | 114752848 | A | * | 7/2022 | ..... C22C 38/02 |
| CN | 114752849 | A | * | 7/2022 | ..... C22C 38/06 |
| GB | 2287956 | A | | 10/1995 | |
| JP | H10204571 | A | | 8/1998 | |
| JP | 2003-147479 | | | 5/2003 | |
| JP | 2016027204 | A | | 2/2016 | |
| RU | 2450079 | C1 | | 5/2012 | |
| RU | 2478727 | C1 | | 4/2013 | |
| RU | 2732272 | C1 | | 9/2020 | |
| WO | 2022152158 | A1 | | 7/2022 | |

OTHER PUBLICATIONS

First Search Report in CN Application No. 202110035295.6 dated Feb. 15, 2023 (with English translation), 5 pages.

First Office Action in CN Application No. 202110035295.6 dated Feb. 16, 2023 (with English translation), 8 pages.

Liu, Hong et al., Engineering Materials, Beijing Institute of Technology Press, ISBN No. 978-7-5682-6989-6, p. 222 (Apr. 30, 2019) [Chinese language version].

Official Action and Search Report in Russian Application No. 2023119566 dated Feb. 7, 2024 [with English translation], 12 pages.

Extended European Search Report for European Patent Application No. 22739036.6 dated Apr. 25, 2024 (11 pages).

Examination report No. 1 for standard patent application for Australian Patent Application No. 2022208884 dated May 28, 2024 (3 pages).

Notice of Reasons for Refusal for Japanese Patent Application No. 541685/2023, dated Aug. 5, 2024 [Japanese and English] 10 pages.

Grounds for Rejection issued by the Korean Intellectual Property Office for Application No. 10-2023-7022934 issued on Feb. 19, 2025 (15 pages).

Brazilian Patent Office Official Action for BR112023013706-3 dated Dec. 1, 2021 with English Translation (7 pages).

* cited by examiner

NON-QUENCHED AND TEMPERED ROUND STEEL WITH HIGH STRENGTH, HIGH TOUGHNESS AND EASY CUTTING AND MANUFACTURING METHOD THEREFOR

CROSS-REFERENCE TO RELATED APPLICATIONS

This application is a U.S. national phase entry under 35 USC § 371 of Patent Cooperation Treaty Application No. PCT/CN2022/071570 filed Jan. 12, 2022, which in turn claims priority from Chinese Patent Application 202110035295.6 filed Jan. 12, 2021. Each of the above-described applications is hereby incorporated herein by reference in their entirety.

TECHNICAL FIELD

The present invention relates to a steel and a manufacturing method therefor, in particular to a non-quenched and tempered steel with high strength, high toughness and easy cutting, and a manufacturing method therefor.

BACKGROUND

A high-strength steel bar is generally used for manufacturing high-safety mechanical and structural components, for example: automobile parts or key stressed components of engineering machinery. Therefore, a high-strength steel should not only have high strength, but also have high strength, high toughness, easy cutting performance and the like.

In the prior art, the high-strength steel is generally produced by selecting appropriate chemical compositions in combination with adoption of quenching+tempering heat treatment process or a controlled rolling+controlled cooling process. When the high-strength steel is produced by adopting the quenching+tempering process, the hardenability of the steel can be improved by optimizing the content of alloying elements, especially the content of a carbon element to enable the steel to form a martensite structure during the cooling process. Such a high-strength steel mainly composed of the martensite has a high dislocation density, which will lead to poor impact toughness of the steel, and if tiny defects such as microcracks occur in the tensile process, the steel will quickly fracture and fail, resulting in low fracture toughness of the steel.

When the high-strength steel is produced in a controlled rolling and controlled cooling manner, although a non-quenched and tempered steel can be obtained without quenching+tempering treatment, due to the large difficulty in process control during the rolling and cooling process, such a production method will affect the overall uniformity of the mechanical performances of the steel.

Since the petroleum crisis in 1970s, under the impetus of energy conservation and environmental protection, countries such as Germany and Japan have successively developed several non-quenched and tempered steels, such as 49MnVS3, 46MnVS6, C70S6, 38MnVS6 and 30MnVS6 on the basis of microalloying technology, and these steels have been widely used. In 1990s, China also developed steel types F45MnV and F35MnVN. In 1995, the national standard GB/T 15712 "Non-quenched and tempered mechanical structural steel" was issued for the first time, and was revised in 2008, thus increasing the steel types to a series of steel types of 10 grades.

A traditional non-quenched and tempered steel usually refers to adding microalloying elements such as vanadium on the basis of low-carbon and medium-carbon steels, and dispersing and precipitating fine carbonitrides in ferrite+pearlite by controlled rolling (forging) and controlled cooling, thereby producing a strengthening effect, so that the steel without quenching and tempering treatment after rolling (forging) can obtain the mechanical performances equivalent to those after quenching and tempering. Novel bainite-type and martensite-type non-quenched and tempered steels have higher strength than the traditional non-quenched and tempered steel. The toughness of the martensite-type non-quenched and tempered steel is relatively low, while the bainite-type non-quenched and tempered steel can reach the strength and toughness of a quenched and tempered alloy structural steel, which is a development direction of a high-strength and toughness non-quenched and tempered steel. Generally, a fine grain or a bainite structure is obtained by adopting chemical composition adjustment, an optimizing process, and the like.

Non-quenched and tempered steels have good economy and certain strength and toughness, and can be widely used in the fields of automobiles and engineering machinery, which is the inevitable trend of future development. However, the non-quenched and tempered steel in the prior art still has the problem of having enough strength and hardness but insufficient toughness.

SUMMARY

One of objectives of the present invention is to provide a non-quenched and tempered round steel with high strength, high toughness and easy cutting, which not only has good impact toughness and plasticity, but also has good fatigue resistance, is easy cutting, and can meet the requirements of application scenarios such as automobiles and engineering machinery on steel performances.

In order to achieve the aforementioned objective, the present invention provides a non-quenched and tempered round steel with high strength, high toughness and easy cutting, comprising the following chemical elements in percentage by mass: C: 0.36-0.45%; Si: 0.20-0.70%; Mn: 1.25-1.85%; Cr: 0.15-0.55%; Ni: 0.10-0.25%; Mo: 0.10-0.25%; Al: 0.02-0.05%; Nb: 0.001-0.040%; V: 0.10-0.25%; S: 0.02-0.06%; and the balance being Fe and inevitable impurities.

In the technical solution of the present invention, a non-quenched and tempered round steel having good impact toughness, plasticity and fatigue resistance and being easy cutting can be obtained through reasonable chemical element composition design. In the present invention, microalloying elements such as vanadium, niobium and aluminum are added, which improves the precipitation strengthening effect of the microalloying elements by utilizing microalloying of element compounding, thereby refining the grains of the microstructure of the round steel. Furthermore, a certain amount of sulfur element is further added into the steel to improve the cutting performance of the non-quenched and tempered round steel in the present invention.

In the non-quenched and tempered round steel in the present invention, the design principle of each chemical element is as follows:

C: C element can improve the hardenability of the steel and make the steel form a phase transformation structure with higher hardness during a quenching and cooling process. When the content of the C element in the steel is increased, the proportion of a hard phase is improved, thereby increasing the hardness of the steel, but meanwhile decreasing toughness of the steel; on the other hand, when the content of the C element in the steel is too low, the content of the phase transformation structure such as bainite in the steel will be too low, and thus the steel cannot obtain sufficient tensile strength. Therefore, in the non-quenched and tempered round steel in the present invention, the mass percentage of the C element is controlled to 0.36-0.45%.

Si: Si element is beneficial to improving the strength of the steel, and adding an appropriate amount of Si can avoid the formation of coarse carbides during tempering of the steel. However, it should be noted that the content of the Si element in the steel should not be too high. When the content of the Si element in the steel is too high, the impact toughness of the steel will be reduced. In the non-quenched and tempered round steel in the present invention, the mass percentage of the Si element can be controlled to 0.20-0.70%.

Mn: Mn is one of the main elements that affect the hardenability of the steel. Mn mainly exists in the form of solid solution in the steel, which can effectively improve the hardenability of the steel and form a low-temperature phase transformation structure with high strength during quenching, making the steel have good strength and toughness. However, it should be noted that the content of the Mn element in the steel should not be too high. When the content of the Mn element in the steel is too high, more residual austenite will be formed, and thus the yield strength of the steel will be reduced, and center segregation is easy to occur. In the non-quenched and tempered round steel in the present invention, the mass percentage of the Mn element is controlled to 1.25-1.85%.

Cr: Cr element can significantly improve the hardenability of the steel. An appropriate amount of the Cr element added into the steel can effectively form a hardened bainite structure, thereby improving the strength of the steel. However, the content of the Cr element in the steel should not be too high. When the content of the Cr element in the steel is too high, coarse carbides will be formed, which will reduce the impact properties of the steel. In the non-quenched and tempered round steel in the present invention, the mass percentage of the Cr element is controlled to 0.15-0.55%.

Ni: Ni exists in the form of solid solution in the steel, and adding an appropriate amount of the Ni element into the steel can effectively improve the low temperature impact properties of the material. However, the content of the Ni element in the steel should not be too high. Too high content of Ni will lead to the high content of residual austenite in the steel, thereby reducing the strength of the steel. In the non-quenched and tempered round steel in the present invention, the mass percentage of the Ni element is controlled to 0.10-0.25%.

Mo: Mo element can exist in the form of solid solution in the steel, and is beneficial to improving the hardenability and strength of the steel. However, considering the cost of the precious alloy Mo, in order to effectively control the cost of alloy, the content of the Mo element in the steel should not be too high. In the non-quenched and tempered round steel in the present invention, the mass percentage of the Mo element is controlled to 0.10-0.25%.

Al: Al element can form fine precipitates with N, thereby achieving pinned grain boundaries and inhibiting the growth of austenite grains. However, it should be noted that the content of the Al element in the steel should not be too high. The too high content of Al will lead to the formation of larger oxides, and coarse hard inclusions will reduce the impact toughness and fatigue performance of the steel. In the non-quenched and tempered round steel in the present invention, the mass percentage of the Al element is controlled to 0.02-0.05%.

Nb: when Nb is added into the steel, a fine precipitated phase can be formed, thereby inhibiting the recrystallization of the steel and effectively refining the grains. Grain refinement plays an important role in improving the mechanical properties of the steel, especially the strength and toughness. Meanwhile, grain refinement also helps to reduce the hydrogen embrittlement susceptibility of the steel. However, the content of the Nb element in the steel should not be too high. When the content of Nb in the steel is too high, coarse NbC particles will be formed during smelting, which instead will reduce the impact toughness of the steel. Therefore, in the non-quenched and tempered round steel in the present invention, the mass percentage of the Nb element is controlled to 0.001-0.040%.

V: V is an important alloying element for strengthening a non-quenched and tempered steel. In the steel, the V element can form precipitates with the C or N element, thereby generating precipitation strengthening, pinning grain boundaries, refining grains and improving the strength of the steel. However, the content of the V element in the steel should not be too high. If the content of the V element in the steel is too high, coarse VC particles will be formed, which will reduce the impact toughness of the steel. Therefore, in the non-quenched and tempered round steel in the present invention, the mass percentage of the V element is controlled to 0.10-0.25%.

S: S element can form sulfide inclusions with the Mn element, thereby improving the cutting performance of the steel. However, it should be noted that when the content of the S element in the steel is too high, too high content of the S element not only is not conducive to thermal processing, but also reduces the impact resistance of the steel. Therefore, in the non-quenched and tempered round steel in the present invention, the mass percentage of the S element is controlled to 0.02-0.06%.

Preferably, the non-quenched and tempered round steel in the present invention further contains Cu, and the content of Cu is: $0<Cu\leq0.25\%$.

Cu can improve the strength of the steel, and is beneficial to improving the weatherability and corrosion resistance of the steel. The content of the Cu element in the steel should not be too high. If the content of Cu in the steel is too high, Cu will be enriched at the grain boundaries during the heating process, which will cause grain boundary weakening and thus cracking. Therefore, in the non-quenched and tempered round steel in the present invention, the mass percentage of Cu can be controlled to $0<Cu\leq0.25\%$.

Preferably, among the aforementioned inevitable impurities, the content of each chemical element in percentage by mass satisfies at least one of: $P\leq0.015\%$; $N\leq0.015\%$; $O\leq0.002\%$; $Ti\leq0.003\%$; and $Ca\leq0.005\%$.

In the aforementioned technical solutions, P, N, O, Ti and Ca are all impurity elements in the steel. In order to obtain a steel with better performance and better quality, the content of the impurity elements in the steel should be reduced as much as possible in case that technical conditions permit.

P: P tends to segregate at the grain boundaries in the steel, which will reduce the grain boundary binding energy and worsen the impact toughness of the steel, and thus the mass percentage of P in the non-quenched and tempered round steel in the present invention is controlled to: $P\leq0.015\%$.

N: N is an interstitial atom, which can form a nitride or carbonitride, i.e., an MX-type precipitate in the steel, which plays a role of strengthening precipitation and refinement. However, too high content of N will cause the formation of coarse particles, which cannot play a role of refining the grains, because N, as the interstitial atom, is enriched at grain boundaries and defects, leading to the reduction of impact toughness of the steel. In order to avoid the enrichment of the N element in the steel, in the non-quenched and tempered round steel in the present invention, the mass percentage of N can be controlled to: N≤0.015%.

O: O can form oxides and composite oxides with the Al element in the steel. In order to ensure the structural uniformity of the steel and make the low-temperature impact energy and fatigue performance of the steel meet the requirements, in the non-quenched and tempered round steel in the present invention, the mass percentage of O can be controlled to: O≤0.002%.

Ti: Ti can form a fine precipitated phase in the steel. When the content of the Ti element in the steel is too high, coarse and angular TiN particles will be formed during the smelting process, which will reduce the impact toughness of the steel. Therefore, in the non-quenched and tempered round steel in the present invention, the mass percentage of Ti can be controlled to: Ti≤0.003%.

Ca: Ca can improve the dimension and morphology of sulfide inclusions in the steel, but the Ca element tends to form coarse inclusions and thus affect the fatigue performance of a final product. Therefore, in the non-quenched and tempered round steel in the present invention, the mass percentage of Ca can be controlled to: Ca≤0.005%.

Preferably, the aforementioned non-quenched and tempered round steel has a value of an ideal critical diameter for hardenability DI of 5.0-9.0; wherein the ideal critical diameter for hardenability DI is calculated according to the following formula, $$DI = 0.54 * C * (5.10 * \mathrm{Mn} - 1.12) * (0.70 * \mathrm{Si} + 1) * (0.363 * \mathrm{Ni} + 1) * (2.16 * \mathrm{Cr} + 1) * (3.00 * \mathrm{Mo} + 1) * (0.365 * \mathrm{Cu} + 1) * (1.73 * \mathrm{V} + 1)$$

wherein each chemical element in the formula represents the numerical value before the percentage sign of the mass percentage of the corresponding chemical element.

In the aforementioned technical solution, when the DI value is lower than 5.0, the hardenability of the steel is insufficient; while when the DI value is higher than 9.0, the steel is difficult to manufacture and high in cost.

Preferably, the non-quenched and tempered round steel has a microalloying element coefficient $r_{M/N}$ of 1.1-9.9; wherein the microalloying element coefficient $r_{M/N}$ is calculated according to the following formula, $$T_{M/N} = ([\mathrm{Al}]/2 + [\mathrm{Nb}]/7 + [\mathrm{V}]/4)/[\mathrm{N}]$$

wherein each chemical element in the formula represents the numerical value before the percentage sign of the mass percentage of the corresponding chemical element.

In the present invention, the microalloying element coefficient rmiN is used for describing the fine dispersion degree of an MX (X refers to C or N) precipitation phase, and Al, Nb and V each can form an MX micro-alloy precipitation phase, which plays a role of refining bainite grains and keeping the grain size stability. If the microalloying element coefficient is too large, coarse precipitation phase will be easily formed in the preparation process of the round steel, thereby reducing the impact toughness and fatigue lifetime of the steel; and if the microalloying element coefficient is too small, no proper number of fine precipitation phases will be formed, and thus they cannot play a role of refining bainite grains.

Preferably, the non-quenched and tempered round steel has a carbon equivalent $C_{eq}$ of 0.60-1.0%; wherein the carbon equivalent $C_{eq}$ is calculated according to the following formula:

$$Ceq = [\mathrm{C}] + [\mathrm{Mn}]/6 + ([Cr] + [\mathrm{Mo}] + [\mathrm{V}])/5 + ([\mathrm{Ni}] + [\mathrm{Cu}])/15$$

wherein each chemical element in the formula represents the numerical value before the percentage sign of the mass percentage of the corresponding chemical element.

In the present invention, if the content of C is too low, it is difficult to meet the strength requirements of the round steel, so the lower limit of the carbon equivalent Ceq needs to be set to 0.60%. On the other hand, if the carbon equivalent Ceq is too high, the toughness of the steel will be reduced, ang thus the upper limit of the carbon equivalent Ceq is set to 1.0%. The carbon equivalent in the non-quenched and tempered round steel in the present invention is controlled to be in the range of 0.60-1.0%, and the specific value can be adjusted according to actual needs, so as to satisfy the use requirements of the non-quenched and tempered round steel of the present invention in different situations.

Preferably, the non-quenched and tempered round steel in the present invention is a non-quenched and tempered steel with a bainite matrix. That is, the non-quenched and tempered round steel has a microstructure comprising bainite, and on any cross-section of the non-quenched and tempered round steel, the area of the bainite accounts for 85% or more of the area of the cross-section.

Preferably, the non-quenched and tempered round steel in the present invention has a bainite transformation temperature $T_B$ of 515-565° C.; wherein the bainite transformation temperature $T_B$ in ° C. is calculated according to the following formula:

$$T_B = 830 - 270 * C - 90 * \mathrm{Mn} - 37 * \mathrm{Ni} - 70 * \mathrm{Cr} - 83 * \mathrm{Mo}$$

wherein each chemical element in the formula represents the numerical value before the percentage sign of the mass percentage of the corresponding chemical element.

In the manufacturing process of the round steel, the steel is cooled to be equal to or less than the bainite transformation temperature $T_B$, so that a bainite structure is formed in the steel.

Preferably, the microstructure of the non-quenched and tempered round steel further comprises residual austenite and at least one of ferrite or pearlite.

Preferably, the non-quenched and tempered round steel has a tensile strength Rm of greater than or equal to 1000 MPa, an elongation A of greater than or equal to 12%, a cross-sectional shrinkage Z of greater than or equal to 35%, and a Charpy impact energy $A_{ku}$ of greater than or equal to 27 J.

In another aspect, the present invention further provides a method for manufacturing a non-quenched and tempered round steel, comprising the following steps:

S1: smelting and casting;

S2: heating;

S3: forging or rolling; and

S4: finishing;

wherein the aforementioned non-quenched and tempered round steel comprises the following chemical components in percentage by mass:

C: 0.36-0.45%; Si: 0.20-0.70%; Mn: 1.25-1.85%; Cr: 0.15-0.55%; Ni: 0.10-0.25%; Mo: 0.10-0.25%; Al: 0.02-0.05%; Nb: 0.001-0.040%; V: 0.10-0.25%; S: 0.02-0.06%; and the balance being Fe and inevitable impurities.

In the aforementioned step S1, the smelting can be performed by electric furnace smelting or converter smelting, and refining and vacuum treatment are performed. In some other embodiments, the smelting can also be performed by employing a vacuum induction furnace. Casting is performed after completion of the smelting. In the aforementioned step S1, casting can be performed by die casting or continuous casting.

Preferably, in the aforementioned step S2, the temperature of the heating is controlled at 1050-1250° C. and kept for 3-24 h, so as to ensure that the non-quenched and tempered steel in the present invention is completely austenitized during the heating process.

Preferably, in the aforementioned step S3, a final rolling temperature or a final forging temperature is controlled to be 800° C. or higher, and cooling is performed after the rolling or the forging. Moreover, in the step S3, for forging, a steel ingot can be directly forged to a final product size; and for rolling, a billet can be directly rolled to a final product size, or the billet is firstly rolled to a specified intermediate billet size, and then subjected to intermediate heating and rolling to the final product size. The intermediate heating temperature of the intermediate billet can be controlled at 1050-1250° C., and kept for 3-24 h. The cooling after the rolling or forging is slow cooling, generally using a cooling speed of smaller than or equal to 1.5° C./s, and the cooling manner can be air cooling or wind cooling.

In the aforementioned step S4, the finishing step can comprise round steel skinning and heat treatment, as well as non-destructive testing for ensuring quality, and the like. Specifically, the skinning procedure performed as required can be skinning by turning or skinning with a grinding wheel and the like; the heat treatment procedure performed as required can be annealing or isothermal annealing, and the like; and the non-destructive testing performed as required can be ultrasonic flaw testing or magnetic particle flaw testing and the like.

Compared with the prior art, the non-quenched and tempered round steel with high strength, high toughness and easy cutting of the present invention and the manufacturing method therefor have the following beneficial effects:

1. In the present invention, by reasonably designing chemical composition in combination with process optimization, a non-quenched and tempered steel having high strength, high toughness and excellent cutting performance is developed. The non-quenched and tempered steel has a structure mainly composed of bainite, and there are fine precipitates dispersed in the bainite matrix, which makes the non-quenched and tempered steel in the present invention have good plasticity, toughness and is easy cutting.

2. The manufacturing process of the non-quenched and tempered round steel in the present invention is well designed and has a wide process window, so that batch commercial production can be realized on a bar production line, and the steel can be used in situations requiring high-strength bars such as automobile crankshafts and shaft parts.

3. The non-quenched and tempered round steel in the present invention not only has good impact toughness and plasticity, but also has good fatigue resistance and easy cutting, wherein the steel has a tensile strength $R_m$ of greater than or equal to 1000 MPa, an elongation A of greater than or equal to 12%, a cross-sectional shrinkage Z of greater than or equal to 35%, and a Charpy impact energy $A_{ku}$ of greater than or equal to 27 J, and can satisfy the use requirements of situations requiring a high-strength and toughness steel, such as automobiles and engineering machinery.

DETAILED DESCRIPTION

Figure 1:
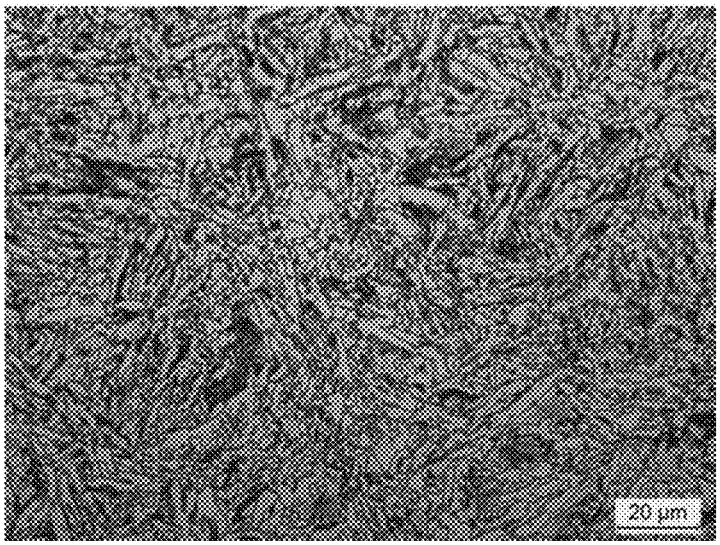
FIG. 1 is a microstructure metallograph of a cross section of a non-quenched and tempered round steel in example 2 under a 500-fold optical microscope.

Embodiments of the present invention will be described below through particular specific examples, and those skilled in the art can easily understand other advantages and effects of the present invention from the contents disclosed in this description. Although the description of the present invention will be introduced in combination with the preferred examples, it does not mean that the features of the present invention are limited to these embodiments. On the contrary, the purpose of introducing the present invention in combination with embodiments is to cover other options or modifications that may be extended based on the claims of the present invention. In order to provide a thorough understanding of the present invention, the following description will contain many specific details. The present invention can also be implemented without these details. In addition, in order to avoid confusing or obscuring the focus of the present invention, some specific details will be omitted in the description. It should be noted that the examples in the present invention and the features in the examples can be combined with each other in the case of no conflict.

Examples 1-6 and Comparative Examples 1-4

The non-quenched and tempered round steels with high strength, high toughness and easy cutting in Examples 1-6 are all prepared by the following steps:

S1: performing smelting and casting according to the chemical compositions shown in following Tables 1-1 and 1-2: wherein the smelting can be performed in a 50 kg or 150 kg vacuum induction furnace, or smelting can be performed in a manner of an electric furnace smelting+refining outside the furnace+vacuum degassing;

S2: heating: the temperature of the heating being controlled at 1050-1250° C., and kept for 3-24 h;

S3: forging or rolling: controlling the final rolling temperature or final forging temperature to be 800° C. or higher; and performing cooling after the rolling or the forging, wherein the cooling speed is controlled to be smaller than or equal to 1.5° C./s, and the cooling manner can be air cooling or wind cooling; and S4: finishing, e.g., skinning.

It should be noted that in the step S3, when forging is performed, a steel ingot is directly forged to a final product size; while when rolling is performed, a billet can be directly rolled to a final product size, or the billet is firstly rolled to a specified intermediate billet size, and then subjected to intermediate heating and rolling to the final product size.

The specific manufacturing process of the non-quenched and tempered round steels in Examples 1-6 and the comparative steels in Comparative Examples 1-4 is as follows.

Example 1: smelting is performed on a 50 kg vacuum induction furnace according to the chemical compositions shown in the following Tables 1-1 and 1-2. Molten steel is cast into a steel ingot, and the steel ingot is heated and is forged into a billet, wherein the heating temperature is 1050° C., and then the forging is performed after holding the temperature for 3 h and a bar with a diameter Φ of 60 mm is finally formed, wherein the final forging temperature is 910° C., and then performing air cooling after the forging.

Example 2: smelting is performed on a 150 kg vacuum induction furnace according to the chemical compositions shown in the following Tables 1-1 and 1-2. Molten steel is cast into a steel ingot, and the steel ingot is heated and is forged into a billet, wherein the heating temperature is 1100° C., and then the forging is performed after holding the temperature for 4 h and a bar with a diameter Φ=92 mm is finally formed, wherein the final forging temperature is 1000° C., and then performing wind cooling, and skinning by turning to Φ=90 mm.

Example 3: performing an electric furnace smelting according to the chemical compositions shown in Tables 1-1 and 1-2, LF refining and VD vacuum treatment, then casting into a 320 mm×425 mm continuous casting billet. The continuous casting billet is first heated to 600° C. in a preheating section, and is continually heated to 980° C. in a first heating section and kept at this temperature, then is continually heated to 1200° C. in a second heating section and kept at this temperature for 8 h, and enters a soaking section at a temperature of 1220° C. and is kept at this temperature for 4 h, and then subjected to subsequent rolling. After leaving the heating furnace and being descaled by high-pressure water, the billet is rolled, and is finally rolled into a bar with Φ=100 mm, wherein a final rolling temperature is 1000° C. The bar is subjected to air cooling after the rolling and is tested by ultrasonic flaw testing and magnetic particle flaw testing and the like.

Example 4: performing an electric furnace smelting according to the chemical compositions shown in Tables 1-1 and 1-2, LF refining and VD vacuum treatment, then casting into a 280 mm×280 mm continuous casting billet. The continuous casting billet is first heated to 620° C. in a preheating section, then is continually heated to 950° C. in a first heating section and kept at this temperature, and is continually heated to 1150° C. in a second heating section and kept at this temperature for 6 h, and then enters a soaking section at a temperature of 1200° C., is kept at this temperature for 2 h, and subjected to subsequent rolling. After leaving the heating furnace and being descaled by high-pressure water, the billet is rolled, and is finally rolled into a bar with Φ=80 mm, wherein the final rolling temperature is 970° C. The bar is subjected to air cooling after the rolling, and then subjected to skinning treatment with a grinding wheel, and is tested by ultrasonic flaw testing and magnetic particle flaw testing and the like.

Example 5: performing an electric furnace smelting according to the chemical compositions shown in Tables 1-1 and 1-2, LF refining and VD vacuum treatment, then casting into a 320 mm×425 mm continuous casting billet. The continuous casting billet is first heated to 600° C. in a preheating section, then is continually heated to 950° C. in a first heating section, kept at this temperature, and is continually heated to 1200° C. in a second heating section, kept at this temperature for 8 h and then enters a soaking section at a temperature of 1230° C., and is kept at this temperature and is subjected to subsequent rolling. After leaving the heating furnace and being descaled by high-pressure water, the billet is rolled into an intermediate billet, wherein the first final rolling temperature is 1050° C., and the size of the intermediate billet is 220 mm×220 mm. After the rolling, the billet is subjected to air cooling. Then the intermediate billet is heated to 680° C. in a preheating section, heated to 1050° C. in a first heating section, heated to 1200° C. in a second heating section, and is kept at this temperature for 6 h, then enters a soaking section with a soaking temperature of 1220° C. After leaving the furnace and being descaled by high-pressure water, the billet is rolled, wherein the second final rolling temperature is 950° C., and the specification of the finished bar is that Φ=60 mm. The bar is subjected to air cooling after the rolling and then is tested by ultrasonic flaw testing and magnetic particle flaw testing and the like.

Example 6: performing an electric furnace smelting according to the chemical compositions shown in Tables 1-1 and 1-2, refining and vacuum treatment, then casting into a 280 mm×280 mm continuous casting billet. The continuous casting billet is first heated to 680° C. in a preheating section first, then is continually heated to 900° C. in a first heating section, kept at this temperature, and is continually heated to 1180° C. in a second heating section and kept at this temperature for 6 h, and then enters a soaking section at a temperature of 1200° C., is kept at this temperature, and is subjected to subsequent rolling. After leaving the furnace and being descaled by high-pressure water, the billet is rolled into an intermediate billet, wherein the first final rolling temperature is 1000° C., and the size of the intermediate billet is 140 mm×140 mm. Then the intermediate billet is preheated to 700° C., heated to 1100° C. in a first heating section, heated to 1220° C. in a second heating section, is kept at this temperature for 5 h, and then enters a soaking section with a soaking temperature of 1220° C. After leaving the furnace and being descaled by high-pressure water, the billet is rolled, wherein the second final rolling temperature is 920° C., and the specification of the finished bar is that Φ=30 mm. The bar is subjected to air cooling after the rolling, then is subjected to skinning treatment by turning, and is tested by ultrasonic flaw testing and magnetic particle flaw testing.

Comparative Example 1: its implementation mode is the same as that of Example 1, comprising the following steps: performing an electric furnace smelting according to the chemical compositions shown in Tables 1-1 and 1-2, refining and vacuum treatment, and then continuously casting into a 280 mm×280 mm square billet. The continuous casting billet is heated to 600° C. in a preheating section first, then heated to 980° C. in a first heating section, kept at this temperature, and is continually heated to 1200° C. in a second heating section and kept at this temperature, and then enters a soaking section at a temperature of 1220° C., is kept at this temperature, and is subjected to subsequent rolling. After leaving the heating furnace and being descaled by high-pressure water, the billet is continuously rolled into a bar with Φ=90 mm, wherein the final rolling temperature is 1000° C. The bar is subjected to air cooling after the rolling, annealing treatment at 650° C., and is tested by ultrasonic flaw testing and magnetic particle flaw testing.

Comparative Example 2: its implementation mode is the same as that of Example 2, including the following steps: performing a smelting on a 150 kg vacuum induction furnace according to the chemical compositions shown in Tables 1-1 and 1-2. Molten steel is cast into a steel ingot, and the steel ingot is heated and is forged into a billets, wherein the heating temperature is 1100° C. the forging is performed after keeping the temperature for 4 h, wherein the final forging temperature is 1000° C., and finally a bar with a diameter Φ=92 mm is formed, then subjected to slow cooling, and skinned by turning to Φ=90 mm.

Comparative Example 3: its implementation mode is the same as that of Example 4, including the following steps: performing an electric furnace smelting according to the chemical compositions shown in Tables 1-1 and 1-2, refining and vacuum treatment, continuously casting into a 280 mm×280 mm square billet. The continuous casting billet is first heated to 680° C. in a preheating section, then is continually heated to 900° C. in a first heating section, kept at this temperature, and is continually heated to 1180° C. in a second heating section, kept at this temperature, and then enters a soaking section at a temperature of 1200° C., is kept at this temperature, and is subjected to subsequent rolling. After leaving the heating furnace and being descaled by high-pressure water, the billet is continuously rolled into a bar with Φ=90 mm, wherein the final rolling temperature is 960° C. The bar is subjected to air cooling after the rolling, annealing treatment at 650° C., and is tested by ultrasonic flaw testing and magnetic particle flaw testing.

Comparative Example 4: its implementation mode is the same as that of Example 5, including the following steps: performing an electric furnace smelting according to the chemical compositions shown in Tables 1-1 and 1-2, refining and vacuum treatment, and then casting into a 320 mm×425 mm continuous casting billet. The continuous casting billet is heated to 600° C. in a preheating section, then is continually heated to 950° C. in a first heating section, kept at this temperature, and is continually heated to 1200° C. in a second heating section, kept at this temperature, and then enters a soaking section at a temperature of 1230° C., is kept at this temperature, and is subjected to subsequent rolling. After leaving the heating furnace and being descaled by high-pressure water, the billet is rolled into an intermediate billet, wherein the first final rolling temperature is 1050° C., and the size of the intermediate billet is 220 mm×220 mm. Then the intermediate billet is heated to 680° C. in a preheating section, heated to 1050° C. in a first heating section, heated to 1200° C. in a second heating section, is kept at this temperature, and then enters a soaking section with a soaking temperature of 1220° C. After leaving the furnace and being descaled by high-pressure water, the billet is rolled, wherein the second final rolling temperature is 950° C., and the specification of the finished bar is that Φ=60 mm. The bar is subjected to air cooling after the rolling and is tested by ultrasonic flaw testing and magnetic particle flaw testing.

Table 1-1 lists the mass percentages of chemical elements of the non-quenched and tempered round steels with high strength, high toughness and easy cutting in Examples 1-6 and he comparative steels in Comparative Examples 1-4.

TABLE 1-1

(wt. %, the balance being Fe and other inevitable impurities except for P, N, O, Ti and Ca)

| No. | Chemical Element | | | | | | | | | | | | | | | |
|---|---|---|---|---|---|---|---|---|---|---|---|---|---|---|---|---|
| | C | Si | Mn | P | S | Cr | Ni | Mo | Cu | Al | V | Ti | Nb | N | 0 | Ca |
| Example 1 | 0.37 | 0.65 | 1.53 | 0.009 | 0.056 | 0.21 | 0.21 | 0.24 | 0.16 | 0.041 | 0.11 | 0.001 | 0.033 | 0.011 | 0.0012 | 0.0014 |
| Example 2 | 0.44 | 0.66 | 1.52 | 0.006 | 0.037 | 0.16 | 0.19 | 0.21 | 0 | 0.032 | 0.22 | 0.001 | 0.031 | 0.009 | 0.0016 | 0.0021 |
| Example 3 | 0.39 | 0.25 | 1.53 | 0.008 | 0.039 | 0.21 | 0.21 | 0.20 | 0.11 | 0.030 | 0.15 | 0.001 | 0.036 | 0.011 | 0.0018 | 0.0042 |
| Example 4 | 0.37 | 0.68 | 1.49 | 0.005 | 0.040 | 0.21 | 0.19 | 0.19 | 0.02 | 0.027 | 0.13 | 0 | 0.030 | 0.013 | 0.0009 | 0.0009 |
| Example 5 | 0.38 | 0.53 | 1.28 | 0.006 | 0.033 | 0.53 | 0.11 | 0.10 | 0.21 | 0.030 | 0.19 | 0.001 | 0.022 | 0.012 | 0.0011 | 0.0026 |
| Example 6 | 0.41 | 0.64 | 1.72 | 0.007 | 0.022 | 0.26 | 0.23 | 0.23 | 0.01 | 0.045 | 0.14 | 0.002 | 0.011 | 0.006 | 0.0016 | 0.0032 |
| Comparative Example 1 | 0.40 | 0.64 | 1.53 | 0.011 | 0.034 | 0.52 | 0.20 | 0.20 | 0 | 0.035 | 0.11 | 0.001 | 0.034 | 0.008 | 0.0013 | 0.0016 |
| Comparative Example 2 | 0.38 | 0.56 | 1.49 | 0.005 | ***0.018*** | ***0.14*** | 0.20 | 0.12 | 0.05 | 0.029 | 0.12 | 0.001 | ***0*** | 0.011 | 0.0014 | 0.0019 |
| Comparative Example 3 | 0.40 | 0.66 | 1.52 | 0.006 | 0.033 | 0.51 | 0.19 | ***0.06*** | 0.01 | 0.034 | 0.11 | 0 | 0.031 | 0.013 | 0.0016 | 0.0031 |
| Comparative Example 4 | ***0.35*** | 0.28 | 1.85 | 10.008 | 0.055 | ***0.58*** | 0.15 | 0.19 | 0.03 | 0.031 | 0.13 | 0.001 | 0.022 | 0.015 | 0.0013 | 0.0025 |

Table 1-2 lists ideal critical diameter for hardenability DI, carbon equivalent Ceq, microalloying coefficient $r_{M/N}$ and bainite transformation temperature $T_B$ calculated from the mass percentages of chemical elements in the non-quenched and tempered round steels with high strength, high toughness and easy cutting in Examples 1-6 and the comparative steels in Comparative Examples 1-4.

TABLE 1-2

| No. | DI value | Microalloying element coefficient $r_{M/N}$ | Carbon equivalent Ceq (%) | Bainite transformation temperature $T_B$ (° C.) |
|---|---|---|---|---|
| Example 1 | 6.6 | 4.8 | 0.76 | 550 |
| Example 2 | 7.5 | 8.4 | 0.82 | 539 |
| Example 3 | 5.4 | 5.2 | 0.78 | 548 |
| Example 4 | 5.8 | 3.9 | 0.74 | 558 |
| Example 5 | 6.3 | 5.5 | 0.78 | 563 |
| Example 6 | 8.8 | 9.9 | 0.84 | 519 |
| Comparative Example 1 | ***9.1*** | 6.2 | 0.83 | 524 |
| Comparative Example 2 | ***4.3*** | 4.1 | 0.72 | ***566*** |
| Comparative Example 3 | 6.7 | 3.8 | 0.80 | 538 |
| Comparative Example 4 | 5.1 | 3.4 | 0.85 | 507 |

In the table above, the DI, the microalloying element coefficient $r_{M/N}$, the carbon equivalent Ceq and the bainite transformation temperature $T_B$ are calculated according to the relevant formulas listed above, respectively.

Table 2 lists the specific process parameters adopted in the manufacturing methods of the non-quenched and tempered round steels in Examples 1-6 and the comparative steels in Comparative Examples 1-4.

TABLE 2

| No. | Smelting, refining and casting process | Heating temperature of cast billet (° C.) | Temperature keeping time of cast billet (h) | Final rolling temperature or final forging temperature (° C.) | Size of intermediate billet | Heating temperature of intermediate billet (° C.) | Temperature keeping time of intermediate billet (h) | Final rolling temperature of intermediate billet (° C.) | Bar specification Φ (mm) |
|---|---|---|---|---|---|---|---|---|---|
| Example 1 | 50 kg vacuum induction furnace + die casting | 1050 | 3 | 910 | / | / | / | / | Φ60 |
| Example 2 | 150 kg vacuum induction furnace + die casting | 1100 | 4 | 1000 | / | / | / | / | Φ90 |
| Example 3 | Electric furnace + refining + continuous casting | 1200 | 8 | 1000 | / | / | / | / | Φ100 |
| Example 4 | Electric furnace + refining + continuous casting | 1150 | 6 | 970 | / | / | / | / | Φ80 |
| Example 5 | Electric furnace + refining + continuous casting | 1200 | 8 | 1050 | 220 mm × 220 mm | 1200 | 6 | 950 | Φ60 |
| Example 6 | Electric furnace + refining + continuous casting | 1180 | 6 | 1000 | 140 mm × 140 mm | 1220 | 5 | 920 | Φ30 |
| Comparative Example 1 | 50 kg vacuum induction furnace + die casting | 1050 | 3 | 910 | / | / | / | / | Φ60 |
| Comparative Example 2 | 150 kg vacuum induction furnace + die casting | 1100 | 4 | 1000 | / | / | / | / | Φ90 |
| Comparative Example 3 | Electric furnace + refining + continuous casting | 1150 | 6 | 970 | / | / | / | / | Φ80 |
| Comparative Example 4 | Electric furnace + refining + continuous casting | 1200 | 8 | 1050 | 220 mm × 220 mm | 1200 | 6 | 950 | Φ60 |

In Table 2, in the three embodiments of Example 5, Example 6 and Comparative Example 4, in the rolling process, the steel billets are first rolled to their respective designated intermediate billet sizes, and then heated and rolled again to the final product sizes.

The non-quenched and tempered round steels obtained in Examples 1-6 and comparative steels in Comparative Examples 1-4 are sampled respectively, and test specimens are prepared with reference to GB/T 2975. Tensile tests and impact tests are carried out according to GB/T 228.1 and GB/T 229, respectively, so as to obtain the mechanical properties of steel plates in the examples and comparative examples.

The non-quenched and tempered round steels are subjected to cutting by an ordinary lathe, and chips are collected to evaluate the cutting performance of the steels: The granular chips that are easy to break are evaluated as "good", while the continuous spiral chips that are not easy to break are evaluated as "poor", and the chips that are presented in a "C" type between the foregoing two are evaluated as "medium". The obtained test results of mechanical properties and cutting performances of the examples and comparative examples are listed in Table 3.

Table 3 lists the test results of the non-quenched and tempered round steels with high strength, high toughness and easy cutting in Examples 1-6 and comparative steels in Comparative Examples 1-2.

TABLE 3

| No. | Yield strength $R_{p0.2}$ (MPa) | Tensile strength $R_m$ (MPa) | Elongation A (%) | Cross-sectional shrinkage Z (%) | Charpy impact energy $A_{ku}$ (J) | Hardness (HBW) | Cutting performance |
|---|---|---|---|---|---|---|---|
| Example 1 | 599/603 | 1,110/1,110 | 21/20 | 41/39 | 42/39/38 | 305 | good |
| Example 2 | 686/669 | 1310/1320 | 17/18.5 | 35/37 | 28/34/30 | 303 | good |
| Example 3 | 601/613 | 1,210/1,190 | 18/20 | 36/39 | 32/31/38 | 302 | good |
| Example 4 | 613/619 | 1,020/1,050 | 17.5/16.5 | 33/31 | 38/38/37 | 296 | good |
| Example 5 | 591/595 | 1,050/1,010 | 16.0/17.0 | 33/32 | 40/39/38 | 300 | good |
| Example 6 | 563/563 | 1,190/1,190 | 16.0/17.5 | 28/27 | 36/35/34 | 330 | medium |
| Comparative Example 1 | 686/633 | 1,300/1,340 | 17.5/18 | 32/34 | 27/27/29 | 334 | medium |
| Comparative Example 2 | 609/600 | 935/910 | 18.0/18.5 | 36/35 | 42/43/40 | 300 | poor |
| Comparative Example 3 | 645/652 | 967/968 | 20.5/21 | 58/60 | 59/38/51 | 301 | medium |
| Comparative Example 4 | 716/700 | 1,100/1,150 | 14/13.5 | 49/50 | 21/25/26 | 321 | medium |

Note:
Groups of data in each column in Table 3 represent the results of two or three tests.

As can be seen from Table 3, the comprehensive properties of the non-quenched and tempered round steels with high strength, high toughness and easy cutting in Examples 1-6 of the present invention are obviously superior to those of the comparative steels in Comparative Examples 1-4. In the present invention, the non-quenched and tempered round steels with high strength, high toughness and easy cutting in Examples 1-6 have a tensile strength $R_m$ of greater than or equal to 1000 MPa, an elongation A of greater than or equal to 12%, a cross-sectional shrinkage Z of greater than or equal to 35%, and a Charpy impact energy $A_{ku}$ of greater than or equal to 27 J, which not only have good impact toughness and plasticity, but also have good fatigue resistance and are easy to cut, and thus can satisfy the use requirements of situations requiring a high-strength and toughness steel, such as automobiles and engineering machinery.

Continually referring to Tables 1-1, 1-2, 2 and 3, it can be seen that the chemical element composition and some related process of Comparative Example 1 all meet the design requirements of the present invention, but compared with Examples 1-6, the ideal critical diameter for hardenability DI in Comparative Example 1 is 9.1, which is not in the preferred range of 5.0-9.0, so that the impact energy in Comparative Example 1 is lower than those of the non-quenched and tempered round steels in Examples 1-6.

Furthermore, in Comparative Examples 2-4, all the three comparative examples have parameters that do not meet the requirements of the design specification of the present invention in the design process of chemical element composition. Therefore, compared with the non-quenched and tempered round steels in Examples 1-6, the comparative steel in Comparative Examples 2 and 3 have lower strength, while the comparative steel in Comparative Example 4 have lower toughness, Comparative Examples 3 and 4 have poor use effects, a crankshaft prepared from Comparative Example 3 have impact energy as low as 23 J, and a crankshaft prepared from Comparative Example 4 is not easy in chip breaking during cutting, resulting in low processing efficiency, thus being unable to meet the requirements of use.

FIG. 1 is a microstructure metallograph of a non-quenched and tempered round steel in Example 2 under a 500-fold optical microscope.

As can be seen from FIG. 1 that the microstructure of the non-quenched and tempered round steel in Example 2 is mainly bainite, and the area percentage of the bainite in the cross section of the round steel is greater than or equal to 85%. Furthermore, in Example 2, the microstructure of the non-quenched and tempered round steel also contains residual austenite and a small amount of ferrite+pearlite.

Figure 2:
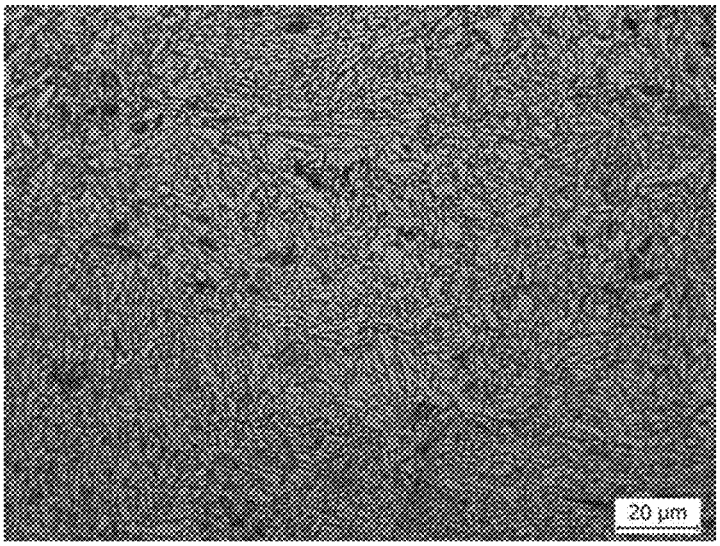
FIG. 2 is a microstructure metallograph of a cross section of a crankshaft prepared by the non-quenched and tempered round steel in example 2 under a 500-fold optical microscope.

FIG. 2 is a microstructure metallograph of a cross section of a crankshaft made of the non-quenched and tempered round steel in Example 2 under a 500-fold optical microscope.

As can be seen from FIG. 2, the microstructure of the crankshaft made of the non-quenched and tempered round steel in Example 2 is bainite.

The combination manner of each technical features in the present application is not limited to the combination manner recorded in the claims of the present application or the combination manner recorded in specific examples. All technical features recorded in the present application can be freely combined or conjoined in any way, unless there are contradictions among them.

It should also be noted that the examples listed above are only specific examples of the present invention. Obviously, the present invention is not limited to the aforementioned examples, and the similar changes or variations that are made accordingly can be directly derived or easily associated by those skilled in the art from the disclosure of the present invention, and all of them belong to the claimed scope of the present invention.

What is claimed is:

1. A non-quenched and tempered round steel, comprising the following chemical elements in percentage by mass: C: 0.36-0.45%; Si: 0.20-0.70%; Mn: 1.25-1.85%; Cr: 0.15-0.53%; Ni: 0.10-0.25%; Mo: 0.10-0.25%; Al: 0.02-0.05%; Nb: 0.001-0.040%; V: 0.10-0.25%; S: 0.02-0.06%; and the balance being Fe and inevitable impurities;

wherein the steel further comprises Cu, and the content of Cu is 0<Cu<0.25% in percentage by mass;

wherein the non-quenched and tempered round steel has a microstructure comprising bainite, and on any cross-section of the non-quenched and tempered round steel, the area of the bainite accounts for 85% or more of the area of the cross-section;

wherein the microstructure of the non-quenched and tempered round steel further comprises residual austenite and at least one of ferrite or pearlite;

wherein the non-quenched and tempered round steel has a tensile strength Rm of greater than or equal to 1000 MPa, an elongation A of greater than or equal to 12%, a cross-sectional shrinkage Z of greater than or equal to 35%, and a Charpy impact energy Aku of greater than or equal to 27 J.

2. The non-quenched and tempered round steel as claimed in claim 1, wherein among the inevitable impurities, the content of each chemical element in percentage by mass satisfies at least one of: P≤0.015%; N≤0.015%; O≤0.002%; Ti≤0.003%; and Ca≤0.005%.

3. The non-quenched and tempered round steel as claimed in claim 1, wherein the non-quenched and tempered round steel has a value of an ideal critical diameter for hardenability DI of 5.0-9.0; wherein the ideal critical diameter for hardenability DI is calculated according to the following formula, $$DI = 0.54 * C * (5.10 * \mathrm{Mn} - 1.12) * (0.70 * \mathrm{Si} + 1) * (0.363 * \mathrm{Ni} + 1) * (2.16 * \mathrm{Cr} + 1) * (3.00 * \mathrm{Mo} + 1) * (0.365 * \mathrm{Cu} + 1) * (1.73 * \mathrm{V} + 1)$$

wherein each chemical element in the formula represents the numerical value before the percentage sign of the mass percentage of the corresponding chemical element.

4. The non-quenched and tempered round steel as claimed in claim 1, wherein the non-quenched and tempered round steel has a microalloying element coefficient $r_{M/N}$ of 1.1-9.9; wherein the microalloying element coefficient $r_{M/N}$ is calculated according to the following formula, $$r_{M/N} = ([\mathrm{Al}]/2 + [\mathrm{Nb}]/7 + [\mathrm{V}]/4)/[\mathrm{N}]$$

wherein each chemical element in the formula represents the numerical value before the percentage sign of the mass percentage of the corresponding chemical element.

5. The non-quenched and tempered round steel as claimed in claim 1, wherein the non-quenched and tempered round steel has a carbon equivalent Ceq of 0.60-1.0%; wherein the carbon equivalent Ceq is calculated according to the following formula:

$$Ceq = [C] + [Mn]/6 + ([Cr] + [Mo] + [V])/5 + ([Ni] + [Cu])/15$$

wherein each chemical element in the formula represents the numerical value before the percentage sign of the mass percentage of the corresponding chemical element.

6. The non-quenched and tempered round steel as claimed in claim 1, wherein the non-quenched and tempered round steel has a bainite transformation temperature TB of 515-565° C.; wherein the bainite transformation temperature TB is calculated according to the following formula:

$$T_B = 830 - 270 * C - 90 * Mn - 37 * Ni - 70 * Cr - 83 * Mo$$

wherein each chemical element in the formula represents the numerical value before the percentage sign of the mass percentage of the corresponding chemical element.

7. A method for manufacturing the non-quenched and tempered round steel of claim 1, comprising the following steps:

Si: smelting and casting;

S2: heating;

S3: forging or rolling; and

S4: finishing;

thereby producing the non-quenched and tempered round steel of claim 1;

wherein the non-quenched and tempered round steel comprising the following chemical components in percentage by mass:

C: 0.36-0.45%; Si: 0.20-0.70%; Mn: 1.25-1.85%; Cr: 0.15-053%; Ni: 0.10-0.25%; Mo: 0.10-0.25%; Al: 0.02-0.05%; Nb: 0.001-0.040%; V: 0.10-0.25%; S: 0.02-0.06%; and the balance being Fe and inevitable impurities;

wherein the steel further comprises Cu, and the content of Cu is 0<Cus0.25% in percentage by mass.

8. The manufacturing method as claimed in claim 7, wherein at least one of the following manufacturing process conditions is satisfied:

in the step S2, the temperature of the heating is controlled at 1050-1250° C., and kept for 3-24 h;

in the step S3, a final rolling temperature or a final forging temperature is controlled to be 800° C. or higher, and cooling is performed after the rolling or the forging.

* * * * *